US005635636A

United States Patent [19]

Alexander

[11] Patent Number: 5,635,636

[45] Date of Patent: Jun. 3, 1997

[54] METHOD OF DETERMINING INFLOW RATES FROM UNDERBALANCED WELLS

[76] Inventor: Lloyd G. Alexander, 1319 Klondike Avenue SW., Calgary, Alberta, Canada, T2V 2L9

[21] Appl. No.: 654,964

[22] Filed: May 29, 1996

[51] Int. Cl.[6] ..... E21B 49/08

[52] U.S. Cl. ..... 73/152.29; 166/250.01

[58] Field of Search ..... 73/152.18, 152.23, 73/152.24, 152.27, 152.28, 152.31, 152.29, 152.37, 152.38, 152.55, 152.05; 166/250.01, 250.02, 250.07; 175/2

[56] References Cited

U.S. PATENT DOCUMENTS

| | | | |
|---|---|---|---|
| 4,123,937 | 11/1978 | Alexander | 73/152.38 |
| 5,249,461 | 10/1993 | Ponder et al. | 73/152.18 |
| 5,551,344 | 9/1996 | Couet et al. | 102/312 |

*Primary Examiner*—Michael Brock
*Attorney, Agent, or Firm*—Sheridan Ross P.C.

[57] ABSTRACT

A method is provided for determining the inflow rates of gas and liquid upon completion of an underbalanced well. The casing is placed, blocking fluid communication between the well and the formation. A tubing string is run in, forming an annular space and a tubing bore. The well is conditioned by removing sufficient liquids to create an underbalanced state and leaving a gas-filled space above any residual liquid. The volume of the gas-filled space in the annular space and the tubing bore is determined. The well is perforated, opening communication between the well and the formation. Pressure within the tubing bore and annulus is measured as a function of time. The rate of change of pressure is dependent upon the nature of the incoming fluid; be it gas or liquid. From the above, the rate of incoming fluid can be established as a function of the volume of the gas-filled space and the rate of change of pressure. The inflow rates of solely gas or solely liquid may be determined whether substantially all the liquid is removed during conditioning or only some of the liquid is removed.

5 Claims, 3 Drawing Sheets

METHOD OF DETERMINING INFLOW RATES FROM UNDERBALANCED WELLS

FIELD OF THE INVENTION

This invention relates to a method of determining inflow rates of solely gas or solely liquid into a well being completed in an underbalanced state.

BACKGROUND OF THE INVENTION

A well is drilled into a subterranean formation for enabling access to gas or oil laying therein. Drilling mud is used to facilitate the drilling operation and to hydrostatically suppress the influx of fluid from any pressurized formations encountered. The well is cased and cemented during which the mud is substantially replaced with water. The casing blocks the flow of fluid from the formation. The casing must be perforated to render the well capable of producing fluid from the formation.

Often the well is completed in an underbalanced condition. This involves "swabbing" or "conditioning" the well by pumping out sufficient liquid so that any water remaining in the well will exert insufficient hydrostatic head to restrain the influx of fluid from the formation upon completion. Underbalanced completion is often practised to flush the well of residual drilling mud, water and cuttings.

After perforation, the wellhead is opened to storage and the effluent is inspected over time to ascertain the composition of the well product. This can take some time, often measured in hours, and is always subject to hazards related to the nature of the effluent.

In related prior art, particular characteristics of a well can be determined without prolonged discharge from the well, as disclosed in U.S. Pat. No. 4,123,937 issued in 1978. This reference discloses a method of determining annular gas rates and gas volume in the well annulus by measuring the rate of flow of gas from the well's annulus, then measuring the change in pressure during blocked flow, and then calculating the gas flow as a function of the ratio of the gas flow to the rate of pressure change using mass balance techniques. This prior art method involving alternately open and then restricted annular flow is applied to pumping wells as a means for determining the annulus gas rate without causing a significant change in the bottom hole pressure.

In accordance with the present invention, applicant has developed a process whereby valuable information pertaining to fluid inflow rates and its nature may be determined during the completion of the well, without release of the well contents.

SUMMARY OF THE INVENTION

The present invention relates to a method involving perforating a well under underbalanced conditions and monitoring pressure in the well after perforation, whereby one is able to determine essential characteristics about the fluid inflow rates and nature of the fluid flowing into the well from the formation.

In one broad aspect of the invention, a method is provided for determining the flowrate of fluid into the wellbore of a well is provided, the well having a tubing string extending downwardly from a wellhead into a casing string which penetrates a fluid-bearing formation, said strings forming an annulus between them, said tubing string having a bore and a means for perforating the casing being located at the tubing string's lower end, the casing initially acting to block communication of the fluid with the wellbore, the method comprising:

removing sufficient liquid from the well so that it is in an underbalanced state and has a gas-filled space formed above any liquid remaining therein;

establishing the volume of the gas-filled space;

blocking all means of fluid egress from the tubing bore and annulus at the wellhead;

perforating the casing at the fluid-bearing formation;

measuring the change in pressure in the tubing bore and annulus over time to determine the pressure change rate as formation fluid flows into the well; and establishing the rate of fluid inflow to the tubing bore and annulus as a function of the volume of the gas-filled space and said pressure change rate.

More specifically, the fluid inflow is preferably calculated in accordance with the relationship $$Q = T_{SC}\frac{\left(V\frac{dP}{dt} + P\frac{dV}{dt}\right)}{TzP_{SC}}$$

where:

Q is the fluid inflow rate, $T_{sc}$ and $P_{sc}$ are the temperature and pressure of the well respectively at standard conditions, V is the volume of the gas-filled space, T and P are the average temperature and the average pressure respectively in the well, dV/dt is the rate of change of the gas-filled volume over time, z is the gas deviation factor, and dP/dt is the rate of change of pressure in the well after perforation of the casing.

Knowledge of the nature of the fluid enables simplification and solution of the above relationship. For solely gaseous fluids, the change in the gas-filled volume dV/dt, remains substantially zero.

Accordingly, in another preferred aspect, liquid in the well is removed to a level substantially at or below that of the intended perforation of the casing. Accordingly, values are substituted into the above relationship for determination of the inflow rates of solely gaseous (Q) fluid flowing from the formation.

In yet another preferred aspect, liquid in the well is only removed to a level sufficient to provide an underbalanced state and yet still results in a liquid level above that of the intended casing perforation. In this instance, so long as the excess liquid is driven upwards in a contiguous slug, then inflow rate of solely gas (Q) is determined by $$Q = \frac{T_{SC}}{P_{SC}Tz}\ \frac{P_C}{P_S}\ V_O\left(1 - \frac{P_S - P_O}{P_S}\right)\frac{dP}{dt}$$

where:

Q is the gaseous inflow rate, $T_{sc}$ and $P_{sc}$ are the temperature and pressure of the well respectively at standard conditions, z is the gas deviation factor, $V_o$ is the volume of the gas-filled space prior to perforation of the casing, T is the average temperature in the well, $P_s$ is the pressure of the gas-filled space measured at the wellhead $P_c$ is the hydrostatic pressure exerted by the height of the liquid cushion and the height of gas in the well above the formation plus the $P_s$, $P_o$ is the original pressure of the gas-filled space measured at the wellhead, and dP/dt is the rate of change of pressure in the well after perforation of the casing.

For solely liquid fluids, the gas flow Q is zero and thus the rate of solely liquid inflow is equal to the rate at which the gas-filled space diminishes being $$\frac{dV}{dt} = \frac{V\frac{dP}{dt}}{P}.$$

DETAILED DESCRIPTION OF THE PREFERRED EMBODIMENT

Figure 1:
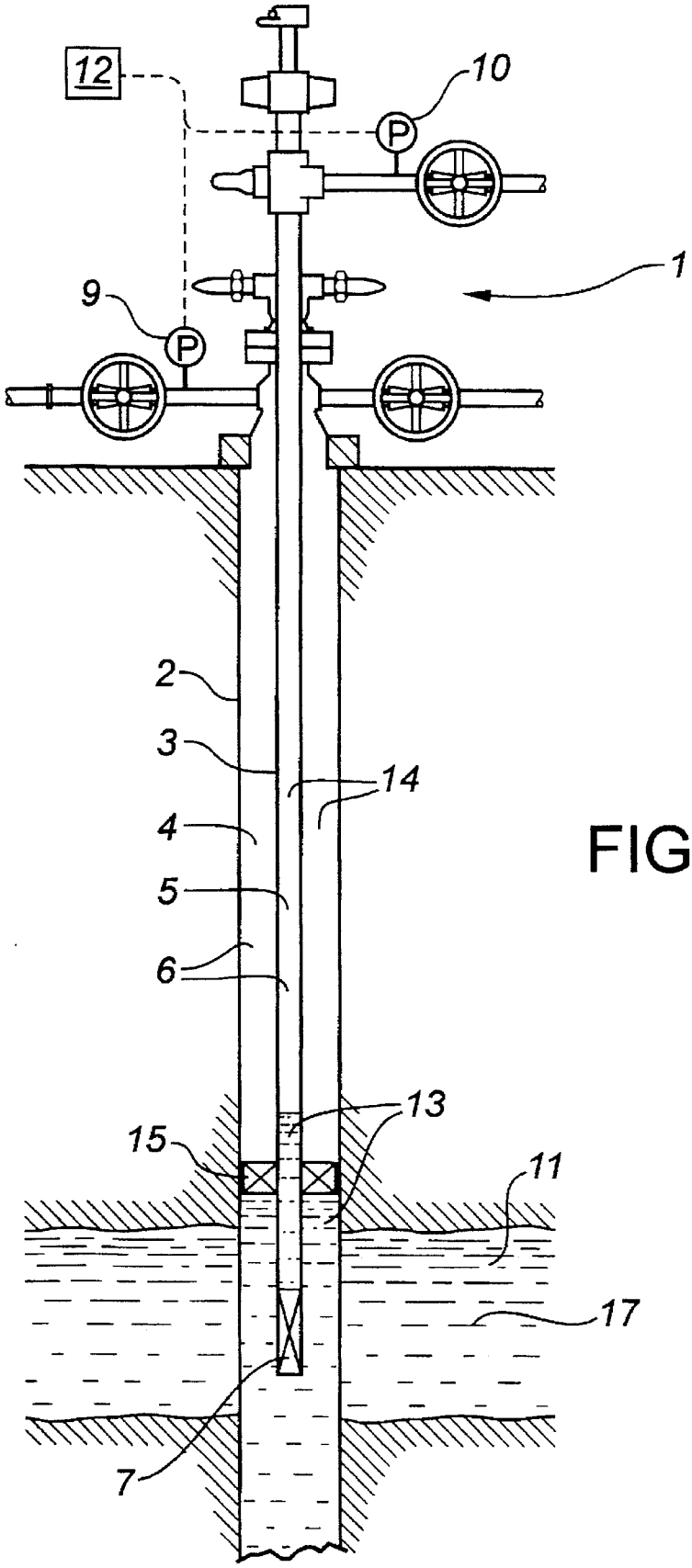
FIG. 1 is a cross-sectional representation of a conventional well, having a casing and tubing string extending into a formation, a packer being located in the annulus formed therebetween, leaving only the bore of tubing in communication with the formation.

Having reference to FIG. 1, a conventional well is shown comprising a wellhead 1, well casing string 2, and a tubing string 3 extending downwardly inside the bore of the casing 2 forming an annular space 4 between them. The casing 2 extends into a formation 11 which contains fluid 17, a gas or a liquid. The tubing string 3 has a bore 5. Together, the annular space 4 and tubing bore 5 form the wellbore 6. A casing perforation means 7 is located at the lower end 8 of the tubing string 3.

An annular pressure measuring means 9 and a tubing pressure measuring means 10 are located at the wellhead 1 and are placed in communication with the wellbore 6. The measuring means 9,10 are connected to a recording means 12.

Figure 2:
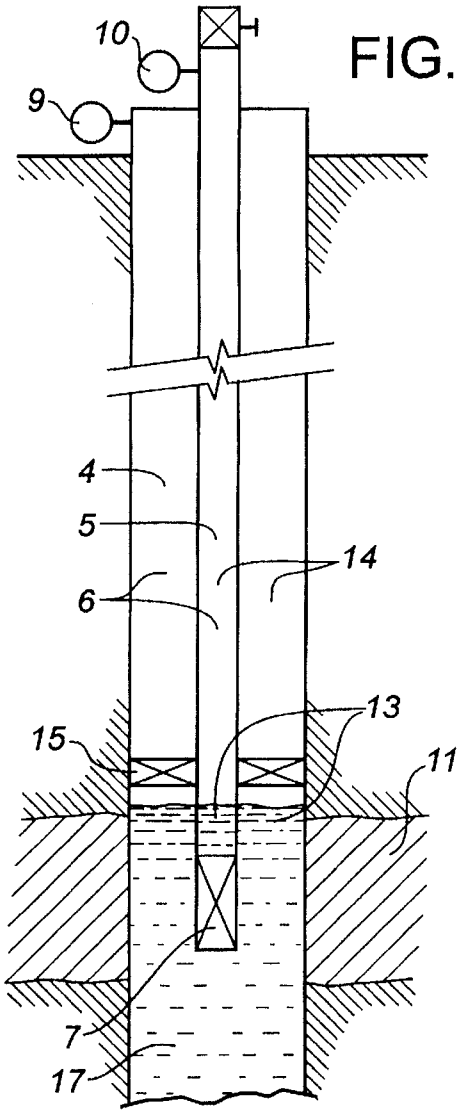
FIG. 2 is a fanciful cross-sectional representation of the well of FIG. 1 showing substantially all liquid having been removed during conditioning. The casing has not yet been perforated.

The well is conditioned by removing the bulk of the liquid 13 remaining in the wellbore 6 after placing the casing 2, the result of which is shown in FIG. 2. Sufficient liquid is removed so that the hydrostatic pressure of the remaining fluid is less than that existing in the formation 11. The well is deemed to be in an underbalanced state.

This process leaves a gas-filled space 14 above any residual liquid in the wellbore 6. The pressure measuring means 9 and 10 are in pressure sensing communication with the gas-filled space 14.

The levels of liquid 13 in both the tubing bore 5 and the annulus 4 may be determined independently by individual sonic testing of each of the tubing bore and annulus. The volume of the gas-filled space 14 in each of the annulus 4 and tubing bore 5 is determined from a knowledge of the casing 2 and tubing string 3 dimensions and the level of the liquid 13 as determined by sonic testing, or by an overall volume determined from an accounting of the total volume of the cased well, less the known volume of liquid removed during conditioning.

The perforation means 7 is used to perforate the casing 2 adjacent its bottom end 8 for permitting fluid 17 from the formation 11 to flow into the wellbore 6.

Depending upon the configuration of the well, the annular space may or may not be live; in other words, should a packer 15 be located in the annular space 4, the gas-filled space thereabove is substantially blocked and insensitive to the flow of fluid from the formation 11. Accordingly, the inflow of fluid 17 into the wellbore 6 will not substantially affect the pressure of the gas-filled space 14 in the annulus above the packer 15.

Thus, fluid 17 can enter wellbore 6 which comprises either the tubing bore 5, the annulus 4 or both. Accordingly, the volume of the gas-filled space 14 comprises only the live, gas-filled volumes of the tubing bore 5 and annulus 4 above the liquid 13.

Once the well has been conditioned and the volume of the live gas-filled space 14 is determined, the wellbore 6 is shut in, and the casing 2 is perforated. High pressure fluid 17 from the formation 11 flows into the lower pressure wellbore 6, increasing the pressure of the gas-filled space 14. The rate of pressure increase will be dependent upon the rate and characteristics of the fluid, be it a gas or a liquid.

Figure 3:
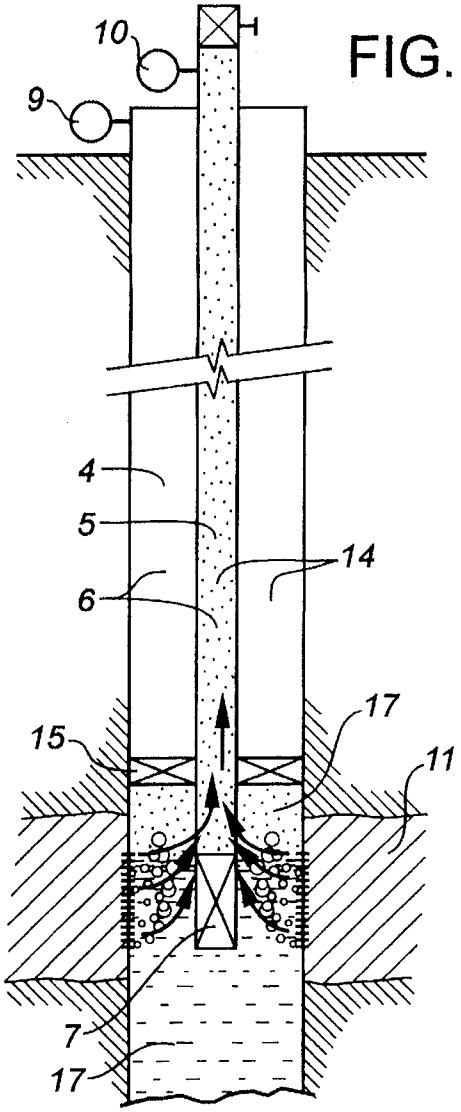
FIG. 3 illustrates the inflow of solely gas from the formation after perforation of the casing of the well of FIG. 2.

As illustrated in FIG. 3, should the incoming fluid be solely gaseous, then the volume of the liquid 13 in the wellbore will not change and the pressure in the gas-filled space 14 will increase relatively rapidly.

Figure 4:
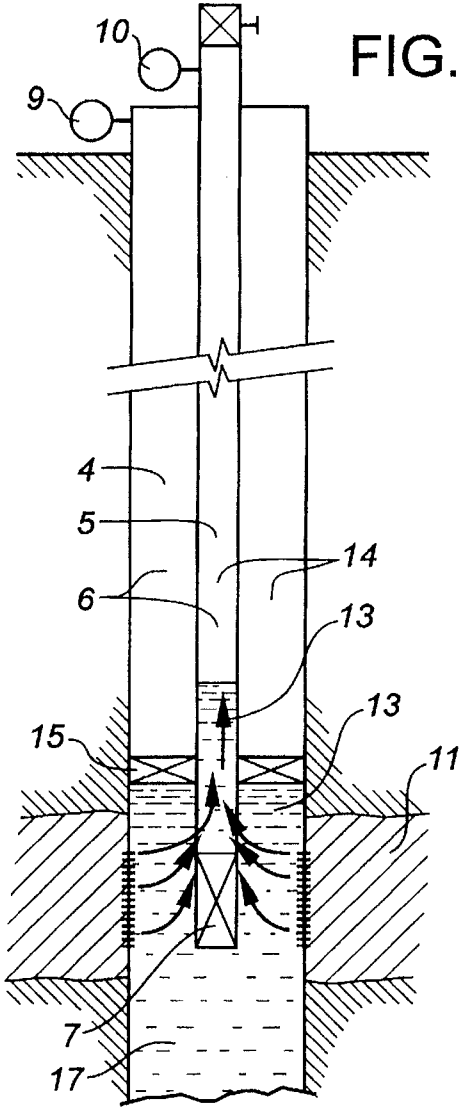
FIG. 4 illustrates the inflow of solely liquid from the formation after perforation of the casing of the well of FIG. 2.

As illustrated in FIG. 4, if the incoming fluid is solely liquid, then the level of the liquid 13 increases accordingly and the pressure in the gas-filled space 14 will still increase albeit at a somewhat lesser rate as the liquid slowly flows in.

For any gas-filled space, a general equation for the behaviour of gases can be derived, which will be familiar to those skilled in the art. The equation has many applications within the oil and gas industry, one of which is the subject of the method according to the present invention.

Generally, nomenclature used is as follows:

M=molecular weight of gas
W=mass of the gas (kg)
P=pressure (kpa abs.)
$Q_1$=gas flowrate into a system ($m^3$/d)
$Q_2$=gas flowrate out of a system ($m^3$d)
T—temperature (deg. K.)
V=gas volume of a system ($m^3$)
n=the number of moles
R=the universal gas constant
z=gas deviation factor
dP/dt=rate of change of pressure (kPa/min)
dV/dt=rate of change of volume ($m^3$/min)

Subscripts:

av=average
s=surface
sc=standard conditions
o=original

A step-by-step derivation is stated as follows:

$$PV=nRTz \quad (1)$$

By replacing the number of moles n, with the weight of the gas divided by the molecular weight of the gas, the equation can then be rewritten as PV=WRTzM or $$W=\frac{PVM}{RTz} \tag{2}$$

where W is the mass of the gas in the system in kilograms.

Similarly, the density of the gas in kg/m$^3$ can be written as:

$$\frac{W}{V}=\frac{PM}{RTz} \tag{3}$$

The mass rate in or out is equivalent to the flow rate of gas in standard m$^3$/min multiplied by the density in kg/m$^3$. Mathematically, this mass rate is expressed as:

$$\text{Mass}_{in}=Q_1\frac{P_{SC}M}{RT_{SC}} \tag{4}$$

Similarly:

$$\text{Mass}_{out}=Q_2\frac{P_{SC}M}{RT_{SC}} \tag{5}$$

where $Q_1$ and $Q_2$ are defined as the gas flowrate in and out of the wellbore respectively.

In order to have a mass balance the rate of change of mass in the system must be equal to the difference between the mass rate in and the mass rate out. Mathematically, this rate of change is expressed as the change in mass in the system over time=mass rate in−mass rate out, or $$\frac{d\left(\frac{PVM}{RTz}\right)}{dt}=Q_1\frac{P_{SC}M}{RT_{SC}}-Q_2\frac{P_{SC}M}{RT_{SC}} \tag{6}$$

If we assume that T and z are constant, equation (6) can then be differentiated as follows:

$$M\frac{\left(V\frac{dP}{dt}+P\frac{dV}{dt}\right)}{RTz})=M\frac{P_{SC}(Q_1-Q_2)}{RT_{SC}} \tag{7}$$

or $$Q_1-Q_2=T_{SC}\frac{\left(V\frac{dP}{dt}+P\frac{dV}{dt}\right)}{TzP_{SC}} \tag{8}$$

The units on both sides of the equation are in m$^3$/min. If we express $Q_1$ and $Q_2$ in m$^3$/day then the left side of the equation must be divided by 1440 minutes per day. If $T_{sc}$=288 degrees Celsius and $P_{sc}$=101.325 kPa, then the equation can be expressed as:

$$Q_1-Q_2=4093\frac{\left(V\frac{dP}{dt}+P\frac{dV}{dt}\right)}{Tz} \tag{9}$$

Equation (9) therefore can be considered to be the fundamental equation that satisfies the mass balance of a system and can be used as a steppingstone in evaluating oil and gas wells, flowing or pumping. The derivation of equation (9) has been previously disclosed in U.S. Pat. No. 4,123,937 to applicant.

In accordance with the present invention, to obtain flowrate and character information on a well that is being perforated under underbalanced conditions, and utilizing equation (8), three scenarios or cases will be examined for which the method of the invention and above equations may be applied.

Case (1)—A well is completely empty of liquid when perforated and produces solely gas (FIG. 3);

Case (2)—A well that produces solely liquid (FIG. 4); and

Figure 5:
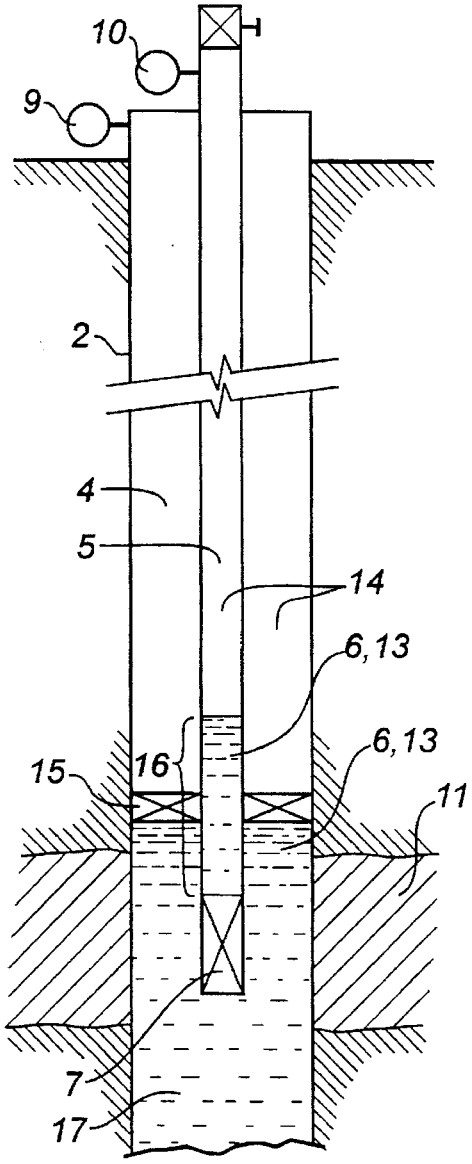
FIG. 5 is a fanciful cross-sectional representation of the well of FIG. 1 showing a cushion of liquid remaining within the well. The casing has not yet been perforated.
Figure 6:
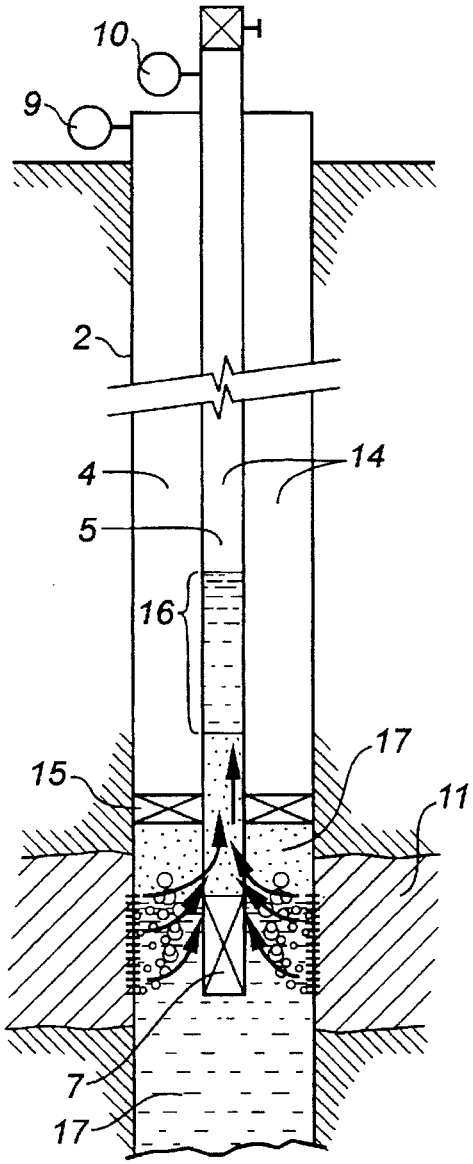
FIG. 6 illustrates the inflow of solely gas from the formation after perforation of the casing of the well of FIG. 5, wherein the liquid cushion is being driven upwards in the bore of the tubing by the inflow of gas beneath it.

Case (3)—A well that is partially full of liquid when perforated and produces solely gas (FIGS. 5 and 6).

For each case, the well is first conditioned to provide a gas-filled space 14 in a wellbore 6 in an underbalanced state. Then the wellbore 6 is shut in so as to block all outflow. The casing 2 is then perforated and pressure in each of the tubing bore 5 and annulus 4 is measured by means 9,10 and recorded with means 12.

Upon perforation, the pressure in the wellbore 6 rises. From the rate of increase of pressure in the gas-filled space 14, an experienced operator can distinguish the inflow of gas from that of a liquid. Higher rates of pressure change (typically greater than 7 kPa/min) generally represent the inflow of gas.

Case (1)

When the conditioning of the well has left the well empty of liquid, and the formation produces solely gas, then upon perforation of the casing the following conditions are known:

the gas flow rate out of the wellbore, $Q_2$=0; and as shown in FIG. 3, the change in gas-filled volume dV/dt= zero as no liquids are being produced to raise the liquid level in the well.

Rewriting equation (9) for this case is as follows:

$$Q_1=4093\frac{\left(V\frac{dP}{dt}\right)}{Tz} \tag{10}$$

The rate of pressure change dP/dt is measured in kPa/min. The gas flowrate into the wellbore is determined by inputting the gas-filled volume, the average tubing temperature, and the appropriate deviation factor z into equation (10).

For example, as illustrated in FIG. 3, if the annulus 4 is blocked by a packer 15, this analysis represents only the gas inflow rate into the tubing bore 5. If the tubing bore volume is 6 m$^3$, the average tubing temperature is 300 degrees Kelvin and the z factor is 0.98, the formula for gas flowrate into the wellbore becomes:

$$Q_1=\frac{4093}{300\cdot 0.98}\ \frac{dP}{dt}=83.5\frac{dP}{dt}$$

At a measured pressure increase of 10 kPa/min, the gas inflow rate is calculated at 83.5 * 10 or 835 m$^3$/day.

If no packer exists, then formation fluids 17 communicate with both the tubing bore 5 and the annulus 4. Equation (10) is then solved for a second time using the gas-filled volume and the rate of pressure change for the annulus 4 instead of the tubing bore 5. The fluid inflow rate is then the sum of the two inflow rates.

Case (2)

As shown in FIG. 4, if a formation produces solely liquid then, without the presence of gas and upon perforation of the casing, the following are known:

$Q_1$=zero (no gas flowing into the wellbore)

$Q_2$=zero (no gas flowing out of the wellbore)

Rewriting equation (9) for this case and since the rate of decrease in the gas-filled space dV/dt equals the rate of increase in the liquid volume−dV/dt, the equation for liquid influx in m$^3$/min can be written as:

$$\frac{dV}{dt} = \frac{V\frac{dP}{dt}}{P} \tag{11}$$

The rate of change of pressure in the well, as liquid enters the wellbore, is measured.

With this equation one merely inputs the known value of the gas-filled volume into the equation and calculates the rate of fluid entry.

For example:

V=6 $m^3$ dP/dt=3 kPa/min

P=100 kPa and accordingly, the inflow rate of liquid into the well is dV/dt=6 * 3/100=0.18 $m^3$/min.

This relationship applies whether the all the liquid was removed during conditioning or hot.

Case (3)

Referring to FIG. 5 and 6, when the wellbore 6 is partially filled with liquid 13 prior to perforating, the liquid located above the level of the intended perforation in the casing is referred to as a liquid cushion 16. The initial pressure at the perforation depth is the sum of the surface pressure at the wellhead 1 plus the hydrostatic head of the gas-filled space 14 and the liquid cushion 16. This pressure is called the cushion pressure or $P_c$.

If the inflow of fluid 17 in the formation is solely liquid, then the relationships described in Case (2) apply.

If the fluid in the formation is solely gas, then an alternate approach applies, as follows.

When the well is perforated, gas enters the tubing bore 5 at the base of the liquid cushion 16 and causes the cushion 16 to be driven upwards in the bore 5 thereby reducing the volume of the gas-filled space 14, thereby increases its pressure. The pressure increase is measured with measuring means 9,10.

If the location of the cushion 16 and the diminishing volume of gas above the cushion is known, then one can determine the inflow rate of gas so long as it remains below the cushion 16 and raises it as a substantially contiguous slug of liquid. Should gas break through the cushion, the analysis is no longer valid. Evidence of a breakthrough is displayed by significant variations in the measured pressures, identifiable by a skilled operator.

We know the original volume of gas $V_o$ above the cushion (the original gas-filled space) and we also know the original surface pressure $P_o$. The changing volume of gas V above the cushion at any other pressure $P_s$ can be calculated by the gas law:

$$P_oV_o=P_sV_s$$

where $V=V_o-V_p$ and $V_p$ is the volume of gas produced under the cushion, or $$P_oV_o=P_s(V_o-V_p)$$

or the volume of gas produced:

$$V_P = V_O\frac{(P_S - P_O)}{P_S}$$

The volume of gas above the cushion at any time is equal to the original volume less the volume of gas produced under the cushion.

$$V = V_O - V_P \text{ or} \tag{12}$$

$$V = V_O - V_O\frac{(P_S - P_O)}{P_S} \text{ or}$$

$$V = V_O\left(1 - \frac{P_S - P_O}{P_S}\right)$$

where $V_o$=original volume of the gas-filled space in the system ($m^3$).

$P_o$=original surface pressure. (kPa abs.).

$P_s$=observed surface pressure as the test progresses (kPa abs.).

$P_c$=cushion pressure (liquid head+gas head+surface pressure. (kPa abs.).

The gas volume factor, $B_g$, relates the volume of gas at any pressure and temperature to the volume of gas at standard conditions, namely 101.325 kPa and 288 degrees Kelvin. The gas formation factor can be calculated from the fundamental gas laws, namely:

$$\frac{P_{SC}V_{SC}}{T_{SC}} = \frac{P_ST_{SC}}{P_{SC}T_Z} \text{ or} \tag{13}$$

$$B_g = \frac{V_{SC}}{V} = \frac{P_ST_{SC}}{P_{SC}T_Z} = 2.8423\frac{P_S}{T_Z}$$

expressed in units of standard $m^3/m^3$, where:

$P_s$=the flowing bottom hole pressure in kPa;

T=the reservoir temperature in degrees K.; and z=the gas deviation factor at $T_2$ and $P_2$.

Equation (11), the rate of fluid influx in $m^3$/min, is multiplied by equation (13) in std $m^3/m^3$ to result in an inflow flowrate calculation with units of std $m^3$/min. A factor of 1440 minutes per day converts the flowrate to std $m^3$/day. Mathematically this can be written as follows:

$$Q = \frac{\left(V\frac{dP}{dt}\right)}{P_S}\,1440\cdot 2.8423\frac{P_2}{T_Z} = 4093\,P_CV\frac{\frac{dP}{dt}}{P_ST_Z} \tag{14}$$

Equation (14) is a solution for determining the gas rate as it enters under the cushion, and is valid as long as the liquid cushion remains as a single contiguous slug above the gas.

The application of the method of the invention to a conditioned well having some liquid remaining therein is provided and an example as follows.

EXAMPLE

A well was drilled and cased. The well had a packer in the annulus, and thus the only gas-filled volume which was live was the tubing volume. The well was conditioned leaving a residual liquid cushion in the tubing bore, comprised substantially of water, at an initial pressure at the wellhead of 200 kPa. Wellhead or surface pressures were monitored under shut in, closed chamber conditions for about 4 minutes duration after perforation of the casing. The measured conditions were applied to the above equations for determination of the fluid inflow rates as a function of the observed surface pressures.

The initial conditions were:

| | |
|---|---|
| Surface pressure | 200 kPa |
| Cushion pressure | 2000 kPa |
| Well volume (gas filled) 10 | $m^3$ |
| Bottom hole temperature | 320 deg K |
| Deviation factor z | .95 |

From equation (14), in its units specific form:

$$Q = 4093\, P_C V \frac{\frac{dP}{dt}}{P_S T z} = \frac{4093}{320 \cdot 0.95} \frac{P_C}{P_S} V_O \left(1 - \frac{P_S - P_O}{P_S}\right) \frac{dP}{dt}$$

which reduced to $$Q = 13.46 \frac{P_C}{P_S} V_O \left(1 - \frac{P_S - P_O}{P_S}\right) \frac{dP}{dt} \quad (15)$$

or in its units generic form, being:

$$Q = \frac{T_{SC}}{P_{SC} T z} \frac{P_C}{P_S} V_O \left(1 - \frac{P_S - P_O}{P_S}\right) \frac{dP}{dt}$$

Table 1 shows the surface pressure response and the flowrate calculations for a four minute closed chamber test on a well having a packer in the annulus, having a water cushion, and a formation which produced solely gas. The well was perforated. The rate of pressure change in the tubing bore was measured. The pressure change rate in the tubing was typical for the inflow of solely gas under a significant liquid cushion. The pressure change in the annulus was zero due to the presence of a packer and was disregarded in the analysis.

TABLE 1

| Time minutes | $P_S$ kPa | $P_C$ kPa | $V_O$ $m^3$ | $1-(P_S-P_O)/P_S$ | eqn. 12 V $m^3$ | $P_C/P_S$ | dP/dt kPa/min | eqn. 15 Q $m^3/d$ |
|---|---|---|---|---|---|---|---|---|
| 0 | 200 | 2200 | 10 | | | | | |
| 1 | 205 | 2205 | 10 | 0.9756098 | 9.75809758 | 10.756098 | 5 | 7066 |
| 2 | 210 | 2210 | 10 | 0.952381 | 9.52380952 | 10.52381 | 5 | 6747 |
| 3 | 220 | 2220 | 10 | 0.9090909 | 9.09090909 | 10.090909 | 10 | 12351 |
| 4 | 235 | 2235 | 10 | 0.8510638 | 8.5108383 | 9.5106383 | 15 | 16347 |

The above example illustrates application of the method for determining the inflow gas rates in a system consisting of the tubing bore only.

In a scenario where the live wellbore volume consists of both the tubing volume and the annular volume, as shown in FIG. 2, then it is necessary to then repeat the above analyses utilizing measured annular pressure change and the known gas-filled space volume in the annulus. Accordingly, the total fluid inflow rates would then be the sum of the determined annular rate and the tubing rate.

The gaseous inflow rate Q can be calculated, using a computer program that uses equation (11) to calculate the instantaneous rate of change of volume and multiplying this value by equation (14) to determine gas flowrate in $m^3$/day. The computer program could track the volume of gas above the cushion and the flowing bottom hole at all times. From the description given a person, knowledgeable in the field, could devise such a program.

While certain embodiments have been chosen to illustrate the subject invention it will be understood that various changes and modifications can be made therein without departing from the scope of the invention as defined in the appended claims.

The embodiments of the invention in which an exclusive property or privilege is claimed are defined as follows:

1. A method of determining the flowrate of fluid into the wellbore of a well, the well having a tubing string extending downwardly from a wellhead into a casing string which penetrates a fluid-bearing formation, said strings forming an annulus between them, said tubing string having a bore and a means for perforating the casing being located at the tubing string's lower end, the casing initially acting to block communication of the fluid with the wellbore, comprising:

removing sufficient liquid from the well so that it is in an underbalanced state and has a gas-filled space being formed above any liquid remaining therein;

establishing the volume of the gas-filled space;

blocking all means of fluid egress from the tubing bore and annulus at the wellhead;

perforating the casing at the fluid-bearing formation;

measuring the change in pressure in the tubing bore and annulus at the wellhead over time to determine its rate of change; and establishing the rate of fluid inflow to the tubing bore and annulus as a function of the volume of the gas-filled space and said pressure change rate.

2. The method as recited in claim 1 wherein the rate of fluid inflow is established using the relationship $$Q = T_{SC} \frac{\left(V \frac{dP}{dt} + P \frac{dV}{dt}\right)}{T z P_{SC}}$$

where Q is the fluid inflow rate, $T_{sc}$ and $P_{sc}$ are the temperature and pressure of the well respectively at standard conditions, V is the volume of the gas-filled space, T and P are the average temperature and the average pressure respectively in the well, dV/dt is the rate of change of the gas-filled volume over time, z is the gas deviation factor and dP/dt is the rate of change of pressure in the well after perforation of the casing.

3. The method as recited in claim 1 wherein sufficient liquid is removed so that prior to perforation of the casing, the resulting liquid level is at or below the fluid-bearing formation, the fluid flowing into the well from the formation is solely gaseous and its rate inflow is established using the relationship $$Q = T_{SC}\frac{\left(V\frac{dP}{dt}\right)}{TzP_{SC}}$$

where Q is the gaseous inflow rate, $T_{sc}$ and $P_{sc}$ are the temperature and pressure of the well respectively at standard conditions, V is the volume of the gas-filled space, T is the average temperature in the well, z is the gas deviation factor and dP/dt is the rate of change of pressure in the well after perforation of the casing.

4. The method as recited in claim 1 wherein the fluid flowing into the well from the formation is solely liquid and its rate is established using the relationship $$\frac{dV}{dt} = \frac{V\frac{dP}{dt}}{P}$$

where dV/dt is the rate of change of the gas-filled volume over time, V is the volume of the gas-filled space, P is the average pressure in the well and dP/dt is the rate of change of pressure in the well after perforation of the casing.

5. The method as recited in claim 1 wherein only enough liquid is removed so that the well is underbalanced and the resulting liquid level is above the fluid-bearing formation, and that after perforation of the casing the fluid flowing into the well from the formation is solely gaseous and acts to drive the liquid laying above the formation up the well in a contiguous cushion, the gaseous inflow rate being established using the relationship $$Q = \frac{T_{SC}}{P_{SC}Tz}\ \frac{P_C}{P_S}\ V_O\left(1 - \frac{P_S - P_O}{P_S}\right)\frac{dP}{dt}$$

where Q is the gaseous inflow rate, $T_{sc}$ and $P_{sc}$ are the temperature and pressure of the well respectively at standard conditions, T is the average temperature in the well, z is the gas deviation factor, $V_o$ is the volume of the gas-filled space prior to perforation of the casing, $P_s$ is the pressure of the gas-filled space measured at the wellhead, $P_o$ is the hydrostatic pressure exerted by the height of the liquid cushion and the height of gas in the well above the formation plus the $P_s$, $P_o$ is the original pressure of the gas-filled space measured at the wellhead and dP/dt is the rate of change of pressure in the well after perforation of the casing.

* * * * *